US006171006B1

(12) United States Patent
Woodall

(10) Patent No.: US 6,171,006 B1
(45) Date of Patent: Jan. 9, 2001

(54) SPORTS BAG FOR HAND CONDITIONING RELATED COMPOSITION AND PREPARATION METHOD

(76) Inventor: Lawrence B. Woodall, 687 Short Town Rd., Liberty, KY (US) 42539

( * ) Notice: Under 35 U.S.C. 154(b), the term of this patent shall be extended for 0 days.

(21) Appl. No.: 08/879,381

(22) Filed: Jun. 20, 1997

(51) Int. Cl.[7] ..... A45D 33/02
(52) U.S. Cl. ..... 401/200; 401/196
(58) Field of Search ..... 401/200, 186, 401/201, 137

(56) References Cited

U.S. PATENT DOCUMENTS

| | | | | |
|---|---|---|---|---|
| 1,808,834 | * | 6/1931 | Busch, Sr. | 401/200 |
| 3,193,869 | * | 7/1965 | Coppock, Jr. | 401/200 |
| 4,006,094 | * | 2/1977 | Pellar | 252/194 |
| 4,368,184 | | 1/1983 | Drucker et al. . | |
| 4,448,560 | * | 5/1984 | Monaco, Jr. | 401/200 |
| 4,572,690 | | 2/1986 | Savanuck . | |
| 4,659,494 | * | 4/1987 | Soldanski et al. | 252/88 |
| 4,682,422 | * | 7/1987 | Harris | 34/9 |
| 4,941,210 | | 7/1990 | Konucik . | |
| 5,014,360 | | 5/1991 | Smith et al. . | |
| 5,364,464 | * | 11/1994 | Sereboff | 106/36 |
| 5,542,374 | * | 8/1996 | Palmer, Jr. | 401/200 |
| 5,565,023 | * | 10/1996 | Sereboff | 106/36 |
| 5,877,138 | * | 3/1999 | Ditze et al. | 510/280 |

* cited by examiner

*Primary Examiner*—David J. Walczak
(74) *Attorney, Agent, or Firm*—King and Schickli, PLLC

(57) ABSTRACT

A permeable bag, and an environmentally friendly composition in the bag, for dispensing by handling to condition the hands of a person is provided. The conditioning is primarily for absorption of excess moisture. The use is particularly suited for participating in a sports activity that requires a natural grip of a disc, ball or the like. The composition is a powder derived from sanding oak flooring; the flooring being approximately 7% moisture content. The powder is preferably extra fine, granulated grade and comprised of particles primarily in the range of 75 $\mu$m–95 $\mu$m in size or diameter and having an irregular outer surface. Other desiccant uses primarily include drying other parts of the body, and in packaging and in protecting electrical equipment. A related method of preparing the composition includes sanding the hardwood flooring, maintaining controlled ambient conditions, screening to size and placement in the bag for use.

5 Claims, 2 Drawing Sheets

(X40)

(X1,000)

(X1,000)

(X1,000)

SPORTS BAG FOR HAND CONDITIONING RELATED COMPOSITION AND PREPARATION METHOD

TECHNICAL FIELD

The present invention relates to desiccants, the manner of use and preparation, and more particularly to a dispenser bag for hand conditioning, having inside a composition of granulated hardwood powder as the desiccant and a preparation method for the powder.

BACKGROUND ART

While water and moisture are essential for life, it is sometimes a nuisance or hinderance and must be controlled. For example, it is important for moisture, especially from high humidity and/or sweat, to be controlled as it tends to collect on the surface of a game piece for a sport and/or on the human body as the game is being played. Such a dilemma is especially troublesome when competing in sports activities that involve throwing and/or catching a projectile. Moisture collecting on the projectile and the hands, can cause a significant deterioration in performance. The problem is particularly acute with regard to successfully handling a projectile, such as a game disc when playing Disc Golf and similar games. The same holds true for games where a ball is used, such as baseball, basketball and football and when a bat, racquet, paddle or the like is required.

The problem in these sport activities stems mainly from impairing or destroying the natural grip of the athlete, as the disc or ball is thrown or caught, or as the bat, paddle or racquet is grasped. Indeed, champion athletes in any sport of this kind agree that grip is essential for accurate and consistent play.

In the past, many suggestions have been offered for products to serve as a powder desiccant to periodically apply to the hands of the athlete. The key shortcoming of these prior art products is that they also tend to act in combination with moisture and excess body oils to make the disc or ball either slicker or more sticky. Indeed, the effect seems to be constantly changing during a game as the moisture content of the atmosphere and/or the degree of sweat of the athlete changes. One instant the disc or ball is too slick and the next instance it may be too sticky, and all variations in between. Essentially, the athlete is left with the natural grip being destroyed. In addition to the natural grip being important when a projectile is being thrown or caught, or when holding a bat, paddle or racquet, it is also important when handling or using any other sports related article or game piece, such as a cue stick when playing pool, bar bells when weight lifting, bow and arrow when shooting archery, a bowling ball during bowling, or an apparatus while performing a gymnastic routine.

Heretofore, the efforts of inventors have been directed to trying to improve the dispenser for the powder composition that serves as the desiccant or antiperspirant. The most common dispenser is a bag or pouch that holds the powder composition within permeable outer layers of cloth or the like. The dispensing takes place by handling the bag, thereby forcing the powder particles through the interstices of the bag. For example, rosin is dispensed in this manner when used by baseball pitchers and batters, and of course it is well known to use chalk powder in a bag for players in such games as pool. However, in either of these instances, the natural grip is impaired or destroyed, especially in the presence of moisture. That is, the game article to hand contact becomes slicker, most often with chalk powder and similar compositions, or more sticky or tacky, which condition is most often associated with rosin, dirt or the like.

As mentioned above, the approach that prior inventors have taken in an attempt to do something to improve the situation has involved redesigning the dispenser for the powder compositions that are to be applied to the skin. While there has been some effort to change the desiccant or antiperspirant composition, insofar as I am aware these developments have focused on simply making a slight change in the basic composition by adding or taking away an element, rather than changing the basic composition. For example, in the U.S. Pat. No. 4,572,690 to Savanuck dated Feb. 3, 1984, the rosin bag-type dispenser is simply modified and the powder composition is adjusted by changing the percentage of known additives. Similarly, the Drucker et al. U.S. Pat. No. 4,368,184 dated Jan. 11, 1983, makes minor changes in a ball or roller type dispenser and makes minor changes in the powder composition that is used as an antiperspirant. Furthermore, while the ingredients of the compositions are generally safe to be applied to the human body, they include modified organic compositions and inorganic compounds that are not only expensive to make, but are not generally recognized as being environmentally friendly.

Because of the failure of such efforts, more recent inventors have taken the different approach of simply trying to use pieces of cloth placed on the body to absorb excess moisture or perspiration. For example, the Konucik U.S. Pat. No. 4,941,210, issued Jul. 17, 1990 provides a sweat band that can be changed quickly so as to better control perspiration on the body. A similar approach directed to perspiration control involves use of moisture-absorbent material for attachment directly to a garment being worn, as illustrated in the Smith et al. U.S. Pat. No. 5,014,360, issued May 14, 1991.

From the foregoing, it can be seen that there is a need for a truly effective system for hand conditioning, primarily for removing excess moisture and restoring the natural grip of the person participating in a sports activity. There is a need also to make the conditioning environmentally friendly, non-allergenic and low cost. It should be a departure from past improvement approaches, that have proven to be generally unsatisfactory in terms of maintaining a natural grip. In other words, something other than slight changes in rosin or chalk compositions should be sought. Also, something that is more effective than simply absorbent pads to be attached to the body or to garments worn by the athlete must be an objective. At the same time, it would be desirable to be able to use the inventive approach to condition other articles or things against excess moisture where it is a problem, such as with respect to moisture on other parts of the human body, in packaging, in electrical equipment or the like.

SUMMARY OF THE INVENTION

Accordingly, it is a primary object of the present invention to provide a dispenser, and a composition to be dispensed, for hand conditioning that overcomes the shortcomings of the prior art.

It is a related object of the present invention to provide a granulated, hardwood powder of relatively low moisture content for hand conditioning and related uses.

It is still another object of the present invention to provide the hardwood powder as a desiccant that is particularly adapted for dispensing from a permeable bag.

Another object of the present invention is to provide the hardwood powder composition and the related dispenser bag, that can be easily used and is highly effective as a desiccant for removal of excess moisture and to restore natural grip.

It is still another object of the present invention to provide such a hardwood powder to be used as a desiccant that is obtained from a hardwood that is low in moisture content.

It is another object of the present invention to provide a related preparation method for the hardwood powder, especially adapted for use as a desiccant, and especially in a sports bag for hand conditioning.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a dispenser and composition for conditioning the hands of a person, including a desiccant for excess moisture is provided that is not only highly efficient, but also environmentally friendly, non-allergenic and inexpensive. As one of the important aspects of the present invention, the desiccant comprises granulated hardwood powder of relatively low moisture content. When the powder is placed in the dispenser, such as a sports bag, for dispensing as it is handled by the athlete, it is highly effective in removing the moisture as desired. Most importantly, it does so in a manner so as to restore the natural grip and feel of the hand on the game article or piece.

The irregular nature of the minute hardwood powder particles is highly effective in attracting the moisture and trapping it. After being brushed off by the athlete, it leaves the hand moisture free, clean and with the natural grip of the hand fully restored. When the powder is used in a bag for dispensing, the interstices in the outer layers that form the reservoir are sufficient in size to allow the desired controlled dispensing.

Preferably, the powder particles are extra fine, primarily in the range of 0.000075–0.000095 meters (75 $\mu$m–95 $\mu$m) in size or diameter. The particles are formed by sanding kiln-dried oak wood and preferably are derived from sanding oak flooring of 5–11% moisture content. More particularly, the flooring is selected with approximately 7% moisture content.

The material for the sports bag that has been found to be the most useful is mid-grade, cotton terry cloth. The layers of the bag are folded over onto themselves, and then stitched along two sides. After the bag is filled with the hardwood powder, it is closed by stitching along the top. Any suitable size, such as 8 cm×8 cm can be used. The terry cloth interstices are ideal for releasing the powder during normal hand action, such as when the athlete alternately squeezes and releases, slaps the bag between his hands and/or shakes the bag, to release the powder into the palms of the hands.

Thus, in use, the bag is held in one hand and squeezed, patted or slapped with the other to release the powder particles through the interstices of the terry cloth layers. Of course, the bag can also be shaken or rubbed on the hands. Once just the right amount of powder is obtained, the bag is dropped and upon rubbing the palms of the two hands back and forth rapidly, all excess moisture is absorbed and drops to the ground. This action is highly efficient in restoring the natural grip and feel of the hands. In addition to moisture, the particles are also very effective in attracting and removal of excess skin oil.

The bag with the granulated hardwood powder is particularly desirable for use on the hands of an athlete engaging in such sports as disc golf, as mentioned above. The hardwood powder is especially good in restoring the fine touch or feel to the fingers, that is so important in disc golf. Also, as will be recognized, the need for removing excess moisture without altering the natural grip or fine touch of the athlete occurs in most other sports where a deft control of a projectile, such as a baseball, is required.

In a related aspect of the present invention, I have provided a method of preparing the granulated hardwood powder that includes the steps of sanding hardwood of relatively low moisture content, maintaining the powder in a low moisture environment, screening the powder to be extra fine and then collecting the powder in a reservoir, such as the sports bag, for the conditioning use. The sanding and screening steps are particularly adapted to maintain the size of the particles in the maximum 75 $\mu$m–95 $\mu$m range. To be most effective, the powder is generated by sanding kiln-dried oak wood in the 5–11% moisture content range, and most preferably approximately 7% moisture content.

In addition to being highly effective for use in conditioning hands of an athlete, the bag with the granulated hardwood powder can serve as a desiccant for drying other parts of the human body, or by simply being placed in packaging for protection of the contents that is to be exposed to humid atmospheric conditions. Furthermore, it is also contemplated as being useful in a similar manner as a desiccant for electrical, or other equipment that is moisture sensitive.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention and together with the description serves to explain the principles of the invention. In the drawings.

Reference will now be made in detail to the present preferred embodiment of the invention, an example of which is illustrated in the accompanying drawings.

DETAILED DESCRIPTION OF THE INVENTION

Figures 1, 2, 6, 6A, 6B, 6C:
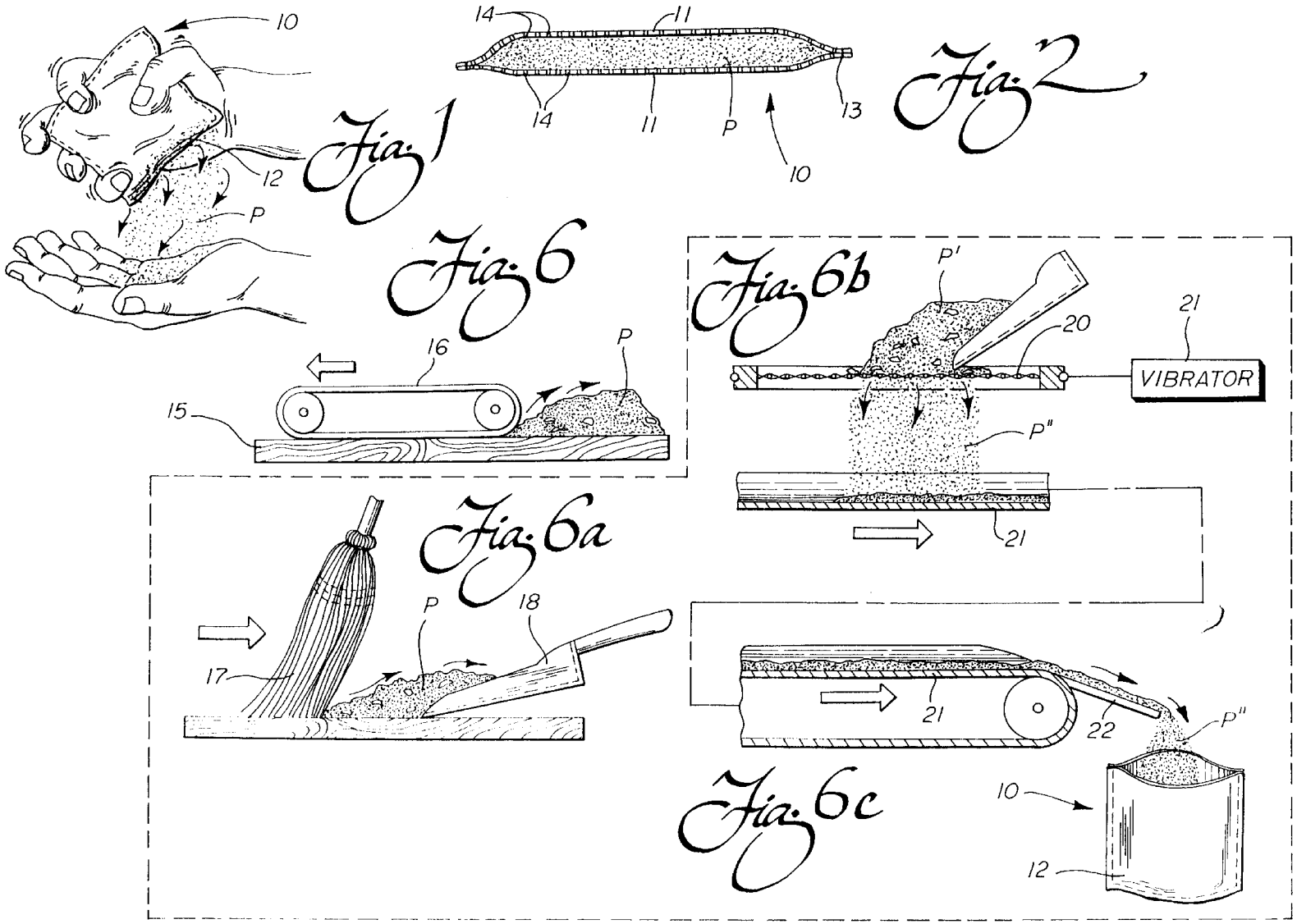
FIG. 1 is an illustration of the dispenser bag of the present invention showing a preferred method of use to provide hand conditioning.
FIG. 2 is a cross sectional view taken through the approximate center of the dispenser bag of the invention.
FIG. 6 is a schematic illustration of a belt sander sanding a piece of oak flooring to generate a raw supply of granulated hardwood power in accordance with the present invention.
FIG. 6*a* is a schematic illustration illustrating the method step of collecting the powder.
FIG. 6*b* is the next step of one embodiment of the method of the invention illustrating the option of screening the hardwood powder to provide size control.
FIG. 6*c* is an illustration of one manner of placement of the granulated hardwood powder into the reservoir within a partially finished dispenser bag.

Reference is now made to FIG. 1 showing a dispenser bag of the present invention, generally designated by the reference numeral 10 being handled by an athlete or other person in a manner to dispense granulated hardwood powder P into the hands. As best illustrated in FIG. 2, the dispenser bag 10 includes outside permeable layers 11 formed by a single fold along the bottom 12 (see FIG. 1) and closed on three sides by stitches 13. Inside the permeable layers 11 is formed a reservoir for the powder P that provides the composition in accordance with the present invention for conditioning the hands of a person. Within the layers 11 are formed minute interstices, represented by the reference numeral 14 in FIG. 2. These interstices are sufficient in size to allow the controlled dispensing of the powder P according to the size of the particles, as will be seen in detail later.

The powder P of the present invention is granulated hardwood powder of relatively low moisture content. It has been discovered that this particular composition provides exceptional properties for absorbing excess moisture and body oils from the hands. An athlete participating in a sport where a game article or piece, such as a disc or ball is involved, can have the natural grip and finger sensitivity restored that is heretofore been hindered by the presence of moisture/oils. As mentioned above, the properties of this desiccant not only provide improved performance for the person using it, but also is environmentally friendly, less expensive, non-allergenic and clean.

Figure 3:
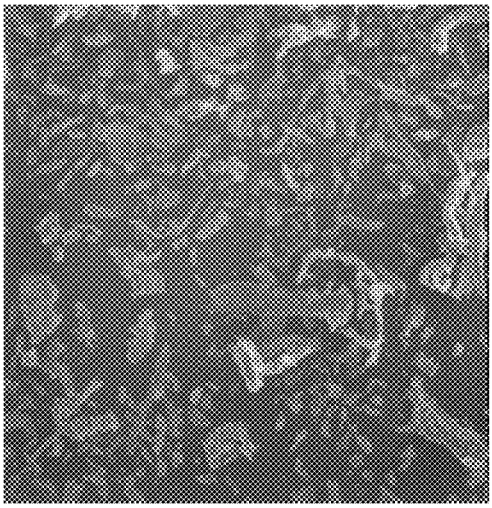
FIG. 3 is a photograph of a preferred form of the composition of the present invention multiplied 40 times as seen on an electron microscope.

In accordance with the preferred embodiment of the present invention, the particles of the powder P are gauged to be extra fine, primarily in the range of 0.000075–0.000095 meters (75 $\mu$m–95 $\mu$m) in maximum size. FIG. 3 is a photograph of the powder P illustrating under 40 power magnification of the particles of the granulated hardwood.

In the preferred embodiment, the powder P of the preferred embodiment is of kiln-dried oak wood, which is what is shown in the photograph. Soft woods, such as pine, are not suitable to be used as the powder composition of the invention. Upon 1000 power magnification, the detail of the landscape of these oak particles can be seen and the absorption power can be better understood. While every aspect and reason of why the hardwood particles absorb moisture/skin oils better, it is believed that one reason centers on the irregular, elongated surfaces, thereby providing many crevices and interstices where the moisture molecules can attach to be absorbed. Furthermore, since the wood is dried to a very low moisture content, that is within the 5–11% range, the moisture is actually taken into the powder particles in a manner similar to a sponge absorbing water.

Preferably, the moisture content is approximately 7%. As the moisture is pulled into the particles, the particles expand and it is trapped permanently. Thus, when the athlete brushes his hands off after the powder P is used, the moisture leaves with the particles. There is an almost total absorption of excess moisture, as well as excess body oils, thus leaving behind no slick and sticky residue, as has been common in the prior art.

Figure 3A:
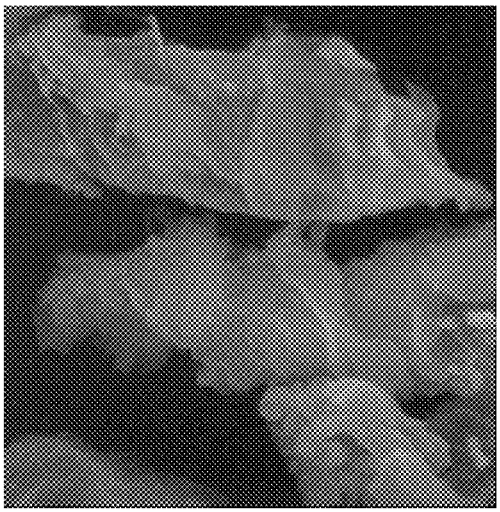
FIG. 3*a* is a photograph of the composition multiplied 1000 times.
Figure 4:
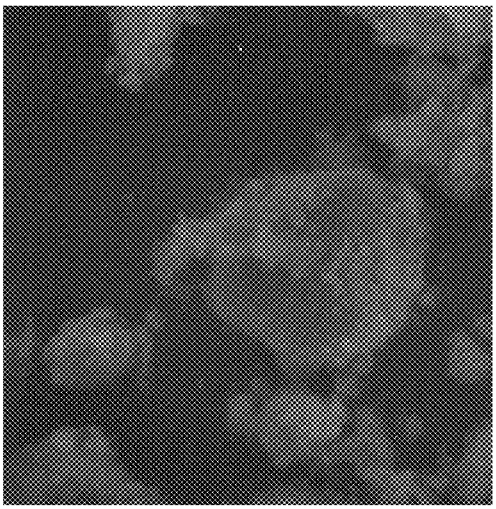
Fig. 4 PRIOR ART
FIG. 4 is a illustration multiplied 1000 times of prior art chalk powder.
Figure 5:
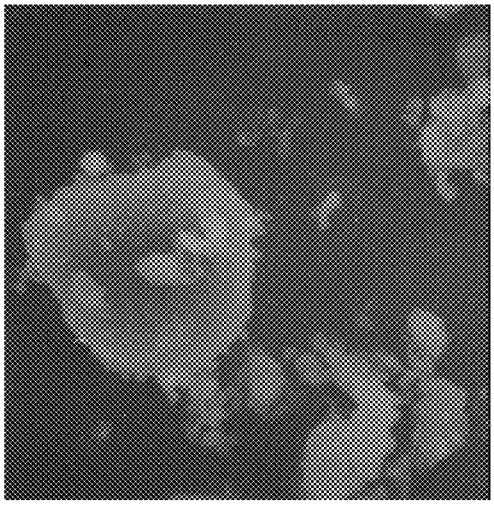
Fig. 5 PRIOR ART
FIG. 5 is a photograph of prior art rosin powder multiplied 1000 times.

A good comparison to the two best known hand conditioners for athletes can be seen by viewing the prior art photograph illustrations of FIGS. 4 and 5. In FIG. 4, there is shown a 1000 power magnification from a scanning electron microscope of chalk powder particles, which as can be seen, do not have the crevices and interstices of the nature provided by the granulated hardwood particles, as viewed in FIG. 3*a*. Indeed, the nature of the chalk particles is basically a smooth surface and in the presence of moisture these particles tend to form a residue that is slick. Thus, using chalk does not provide the natural grip and the fine tuned feel of the fingers of the hand of an athlete. Especially in the game of disc golf, the precision needed to hit the target precisely and consistently would be lost if chalk powder is used for conditioning.

Similarly, comparison and a better understanding of why rosin is a bad choice, especially in the presence of moisture, can be seen by viewing FIG. 5. The rosin particles are smooth surfaced as can be fully recognized in this 1000 power enlargement by a scanning electron microscope. Instead of attracting moisture like a magnet or sponge, as described with regard to the hardwood particles of FIG. 3*a*, the rosin particles repel moisture in a manner similar to wax on a car. It is also noticed by experiment that the moisture and body oils mix with some of the smaller rosin particles forming a sticky paste residue that is left on the hands. Again, the result is that the natural grip and the feel in the fingers of the athlete is lost. As the projectile, such as the disc in disc golf is released, the stickiness or tackiness causes just enough erratic movement to result in the target being missed.

From this comparison, it will be realized that using the principles of the present invention with granulated hardwood powder as a desiccant on hands of an athlete, provides the advantage of insuring a natural grip, total feel of the hand and especially in the fingers thus enhancing the performance. This approach of using a totally natural product is a vast departure from the past where the composition is not totally natural and those ingredients that are natural are modified. Rather than simply trying to improve the compositions of the past, the present invention represents a bold departure from the past, and exceptional results are provided.

With reference now to FIGS. 6–6*c*, the method of preparing the powder P of the present invention can be more fully described. In the schematic illustration of FIG. 6, oak flooring 15 is being sanded by a typical belt sander 16. The belt moves in an endless path in accordance with the arrow in this figure. A supply of the powder P is generated in the manner illustrated. The particles vary in size and are not uniform. In FIG. 6*a*, the powder is scooped in a normal fashion, as represented by the broom 17 and the pan 18.

The dashed line encompassing FIG. 6*a*, as well as FIGS. 6*b* and 6*c*, represents that the powder selectively collected and then processed for placement into the dispenser bag 10 must be dry. As mentioned above, the preferred moisture content is approximately 7%, and thus any powder that is wet or has been exposed to moisture, should not be collected. In accordance with one method for low volume production of the dispenser bags 10, the powder P can at this point be placed directly through the top of the bag 10 and the stitching 13 completed. This short production method makes a perfectly satisfactory finished product in accordance with the invention. Because the interstices 14 of the layers 11 of the bag 10 are a particular size, any larger size particles than the desired size are simply retained in the bag 10. In other words, only the optimum sized particles are dispensed for use. In this respect, it has been found that mid-grade cotton terry cloth is ideal for forming the dispenser bag 10. The interstices 14 allow the passage of particles up to the range of 75 μm–95 μm, and the residue of larger particles is retained inside the bag.

If desired, the preparation method can be expanded by taking the powder collected in FIG. 6*a* and providing further processing. As illustrated, the powder P' now passes through screen 20, thus removing the larger particles. This extra step allows only particles of up to the desired maximum size to make up the final powder P" to fill the reservoir in the bag 10. If desired, the screen 20 can be vibrated by a vibrator 21 to speed the process. The final powder P" drops onto a conveyor 21 for eventual delivery to a discharge chute 22, as seen in FIG. 6*c*. The screened powder P" is placed into the open top dispenser bag 10 and after being filled the final stitching 13 is added (see FIGS. 1 and 2). Since only particles within the maximum size to be dispensed through the interstices 14 of the bag 10 are placed in the finished dispenser bag 10 by utilizing the extra method steps of 6*b*, 6*c*, there is no residue left over and the effective life of the bag is extended.

The advantages of the present invention covering the dispenser bag 10 including the granulated hardwood powder P as a desiccant inside, the powder composition itself and the method of preparation, all as illustrated in the drawings and described, can now be fully understood. The dispenser bag 10 provides exceptional hand drying efficiency since the particles of the granulated hardwood powder P, preferably powder derived from oak flooring, absorbs moisture in a much more efficient manner. As illustrated in the photographs of FIGS. 3–5, the hardwood powder particles are exceptionally well suited, especially as compared to the prior art chalk and rosin particles. Preferably, the maximum size or diameter of the particles is in the range of 75 μm–95 μm and the preferred hardwood powder is obtained from sanding kiln-dried oak wood. The moisture content of oak flooring in the range 5–11% moisture content, and more preferably approximately 7% moisture content is ideal for the purpose. In addition to conditioning hands for an athlete, it is contemplated that the present invention can be utilized for drying other parts of the body, used as a desiccant in packaging, and for protection of electrical equipment or the like that is moisture sensitive.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

What is claimed is:

1. A dispenser bag for conditioning the hands of a person, including a desiccant inside for excess moisture, comprising:

spaced permeable layers with interstices and forming an interior reservoir;

granulated hardwood powder of relatively low moisture content held in said reservoir forming said desiccant; and said hardwood powder being substantially a size obtained from sanding hardwood;

the interstices in said layers being sufficient in size to allow controlled dispensing of said powder when handled, whereby conditioning including moisture absorption is provided to give a natural grip of an article.

2. The bag of claim 1, wherein said powder has particles that are extra fine, primarily in the range of 0.000075–0.000095 meters in maximum size.

3. The bag of claim 1, wherein said powder particles are formed by sanding kiln-dried oak wood.

4. The bag of claim 3, wherein said powder particles are derived from oak flooring of 5–11% moisture content.

5. The bag of claim 4, wherein said flooring has a moisture content of approximately 7%.

* * * * *